US005351767A

United States Patent [19]

Stogner et al.

[11] Patent Number: 5,351,767

[45] Date of Patent: Oct. 4, 1994

[54] DRILL PIPE HANDLING

[75] Inventors: Huey Stogner, League City; Craig A. Watson, Katy, both of Tex.

[73] Assignee: Globral Marine Inc., Houston, Tex.

[21] Appl. No.: 972,469

[22] PCT Filed: Oct. 29, 1991

[86] PCT No.: PCT/US92/09257

§ 371 Date: Dec. 21, 1992

§ 102(e) Date: Dec. 21, 1992

[51] Int. Cl.[5] ..... E21B 19/00

[52] U.S. Cl. ..... 175/162; 175/85; 175/203

[58] Field of Search ..... 166/77, 77.5; 175/57, 175/85, 162, 203

[56] References Cited

U.S. PATENT DOCUMENTS 3,719,238 3/1973 Campbell et al. ..... 175/203 X
4,610,315 9/1986 Koga et al. ..... 175/85
4,738,321 4/1988 Oliver ..... 175/82
4,843,945 7/1989 Dinsdale ..... 175/85 X
4,854,400 8/1989 Simpson ..... 175/85 X

*Primary Examiner*—Thuy M. Bui
*Attorney, Agent, or Firm*—Christie, Parker & Hale

[57] ABSTRACT

Multi-joint stands 126, 127 of drill pipe are assembled and disassembled in a drilling rig 15 by use of a powered mousehole 11 concurrently with well drilling operations conducted by use of a drill string top drive system 23. The powered mousehole 11 has an upwardly open bowl 45 in a floor 17 of the drilling rig which can be rotated about a vertical axis 55. A pipe joint 110 held in the bowl, and depending from it, can be screwed, with controlled levels of torque, into connection with a second pipe joint 113 suspended vertically above the first joint 110 by a hoist system 13 which is separate from hoisting equipment 19 carrying the top drive system 23 over a well bore 21. The second pipe joint 113 is held from rotation by a tong assembly 12, but can move axially against a yieldable support 40 into threaded connection with the first joint 110.

31 Claims, 13 Drawing Sheets

38
18
19
23
116
39
114
113
24
110
12
36
22
11
115

DRILL PIPE HANDLING

FIELD OF THE INVENTION

The present invention pertains to oil field drill pipe handling procedures and equipment. More particularly, it pertains to procedures for making up multi-joint stands of drill pipe by use of a rotary mousehole during top drive drilling operations.

BACKGROUND OF THE INVENTION

Oil well drilling procedures are now well developed and known. Typically, a rotating string of drill pipe, composed of individual sections (also called "joints") of drill pipe each typically 30 feet in length, carries at its lower end a drill bit which bores into the earth. As the bit bores deeper, additional joints of pipe are added to the string. Until relatively recently, the drill string typically was rotated about its axis by use of a rotary table located on a drilling platform in combination with a special section of drill string called a kelly joint or, more simply, a kelly. The rotary table typically is located in the platform floor directly below the path of vertical movement of a traveling block suspended in a derrick erected over the platform. The kelly is a non-round, often hexagonal, section of heavy-wall drill pipe, typically 42 feet in length, which forms the uppermost section of the drill string during drilling operations using a rotary table. The rotary table includes a power driven annular collar configured to slidably mate with the non-round configuration of the kelly, thereby to rotate the drill string and to power the drill bit.

When drilling with a rotary table and a kelly, the pipe string is drilled "kelly down", i.e., the length of the kelly joint, after which the kelly is raised above the rotary table. The drill string then is secured from downward movement in the rotary table, and the kelly is disconnected from the drill string. An additional 30 foot joint of drill pipe is added to the string and the kelly is then reconnected to the drill string. The string then is lowered through the rotary table to enable the kelly to engage, adjacent its lower end, in driving relation to the rotary table collar. Drilling operations are then resumed and continued to extend the well bore another 30 feet or so, at which time it is necessary to add another joint to the drill string. A new joint of drill pipe is added to the drill string each time the well bore is extended 30 feet or so, and each such addition requires performance of the operations described above.

In connection with oil and gas well drilling by use of rotary table equipment, additional features of the drilling equipment were developed, notably a mousehole and a rathole. A mousehole is a substantially vertically disposed tubular sleeve located in the drilling rig with its upper end at the platform closely adjacent the rotary table center. The mousehole is used to hold the next joint of drill pipe which is to be added to the drill string. The rathole is a somewhat larger diameter and often longer length tubular sleeve or the like also located in the drilling rig floor; it serves as a receptacle for the kelly.

Recently, a form of mechanism different from a rotary table has gained widespread acceptance in the oil and gas drilling industry for rotating a drill pipe string. That new equipment is known as a top drive. A top drive drilling mechanism and related equipment is supported by and below the traveling block for movement vertically along the well bore axis and for connection directly to the drill string. The top drive mechanism includes a motor, such as a DC electric motor, which operates to turn a coupling to which the upper end of the pipe string can be connected. Use of top drive drilling procedures eliminates the need for the long kelly joint and the need for disconnecting the kelly joint from the drill string each time it becomes necessary to increase the length of the drill string. Also, drill pipe can be added to the drill string in units of two or three joint "stands", i.e., multi-joint increments of drill string 60 or 90 feet in length, with a corresponding reduction in man hours expended in drilling a well of specified depth.

To take advantage of the drilling efficiencies obtainable with top drive systems, it is now appropriate to make-up double or triple (thribble) joint stands of drill pipe while drilling operations are in progress. However, commercial drilling rigs are not normally equipped to do this effectively, and so the pipe joints are made up into stands manually using hoists, chains and tongs developed for use in rotary table drilling procedures. Frequently the task of making up double or thribble stands of drill string cannot be completed fast enough to keep up with drilling, and so the efficiencies possible from use of top drive drill procedures are not being fully realized.

A problem commonly encountered when making up doubles and thribbles for top drive drilling is to ensure proper alignment of the tool joint ends. Each joint has an externally threaded coupling moiety at one end, called a "pin", and a cooperating internally threaded coupling moiety called a "box", at its other end. Drill strings typically are assembled with each joint in the string joint disposed pin end down. Because the travelling block in a drill rig derrick generally cannot be moved laterally in the derrick, a reserve pipe held in a mousehole must be angled for positioning to a joint suspended by the travelling block or by other hoists located other than directly vertically above the mousehole. Thus, stand make-up procedures cannot take advantage of gravity to obtain proper alignment between individual pipe joints being assembled to define a stand. Oil and gas well drill pipe is heavy and thus is difficult to handle manually. Misalignment of the pin and box ends of adjacent joints can slow the task of making up a stand and can lead to galling or other thread mutilation conditions. Additional problems encountered include applying the proper amount of torque to one or the other of the joints being connected by use of chain tongs. Usually, overall torque is measured only when the double or thribble is attached to the top drive unit, and there is no measurement or control of torque at each connection between joints in the stand.

U.S. Pat. No. 3,293,959 to Kennard discloses a pipe support well tool. The device is mounted over the rathole on a drilling platform. A housing includes a means for supporting a length of pipe to be added to the drill string and clamping means for securing the pipe from rotation during make-up with the kelly joint. The housing is mounted on spring legs such that the pipe to be made up will be resiliently supported and upwardly biased to the kelly joint. A winch having a cable and stabbing hook swings the kelly joint into position over the housing and vertically aligns it with the pipe joint supported by the housing.

Other U.S. patents of interest include U.S. Pat. Nos. 3,144,085, 3,212,578; 4,290,495 to Elliston; 3,662,842 to Bromell; 1,417,490 to Brandon; 1,908,818 to Brown;

2,142,022 to Volpin; 2,245,960 to Claire; 2,321,245 to Reed; 4,403,666 to Willis; and 4,591,007 to Shaginian et at.

In view of the foregoing, it is apparent that a need exists for improvements in the procedures and equipment available in top drive drill rigs to enable more efficient and effective assembly of multi-joint stands of drill pipe while top drive drilling procedures are occurring. Such improvements desirably should include procedures and devices which take maximum advantage of gravity to significantly reduce, if not eliminate, the need for manual handling of single and plural pipe joints. Also, the improvements desirably should include techniques and equipment for accurately and efficiently aligning the pin and box ends of two joints to be connected and for threading those joints together with known levels of torque. Further, the equipment should be maximally workable and useful with existing drill rig arrangements and procedures to avoid clutter on the drilling platform and to reduce the need for retraining of rig personnel. Further, the equipment providing the desired improvements should be compatible with, and able to co-exist with, rotary table drilling arrangements and procedures which have advantage under certain drilling conditions.

SUMMARY OF THE INVENTION

This invention addresses the need identified above. It does so by providing improved procedures and equipment for effectively and efficiently enabling multi-joint stands of drill pipe to be assembled in a drilling rig during the performance of top drive drilling operations without interfering with such operations. Use of the improved procedures and equipment provided by this invention permits better realization of the advantages and efficiencies attainable with top drive drilling procedures.

Generally speaking, in terms of procedural aspects, this invention provides a method for making up, in a well drilling rig having a platform beneath a derrick in which a hoist is moveable along a vertical path above a well bore, a drill pipe stand. The drill pipe stand is comprised of plural individual lengths of drill pipe having cooperating pin and box threaded coupling moieties at their opposite ends. The method includes supporting a drivable annular pipe rotating member for rotation about a substantially vertical axis in a hole in the platform adjacent the well bore. The method also includes engaging a first pipe length adjacent the box end thereof in the annular member in vertically supported, torque transmitting relation to the member, with the first pipe length below the annular member in essential alignment with that axis. Further, the method includes moving the pin end of a vertically disposed second pipe length along the axis into essentially aligned engagement with the box end of the first pipe length. Another step in the method is that of holding the second pipe length from rotation about the axis while yieldably supporting the second pipe length for limited movement along the axis. Still another step in the method is that of rotating the annular member about the axis in a direction causing the pin and box ends of the first and second pipe lengths to thread together to form a drill pipe stand.

DESCRIPTION OF THE DRAWINGS

The above-mentioned and other features and advantages of this invention are more fully set forth in the following description of presently preferred and other embodiments of the procedural and structural aspects of the invention, which description is presented with reference to the accompanying drawings wherein.

DESCRIPTION OF THE ILLUSTRATED EMBODIMENT

Figure 1:
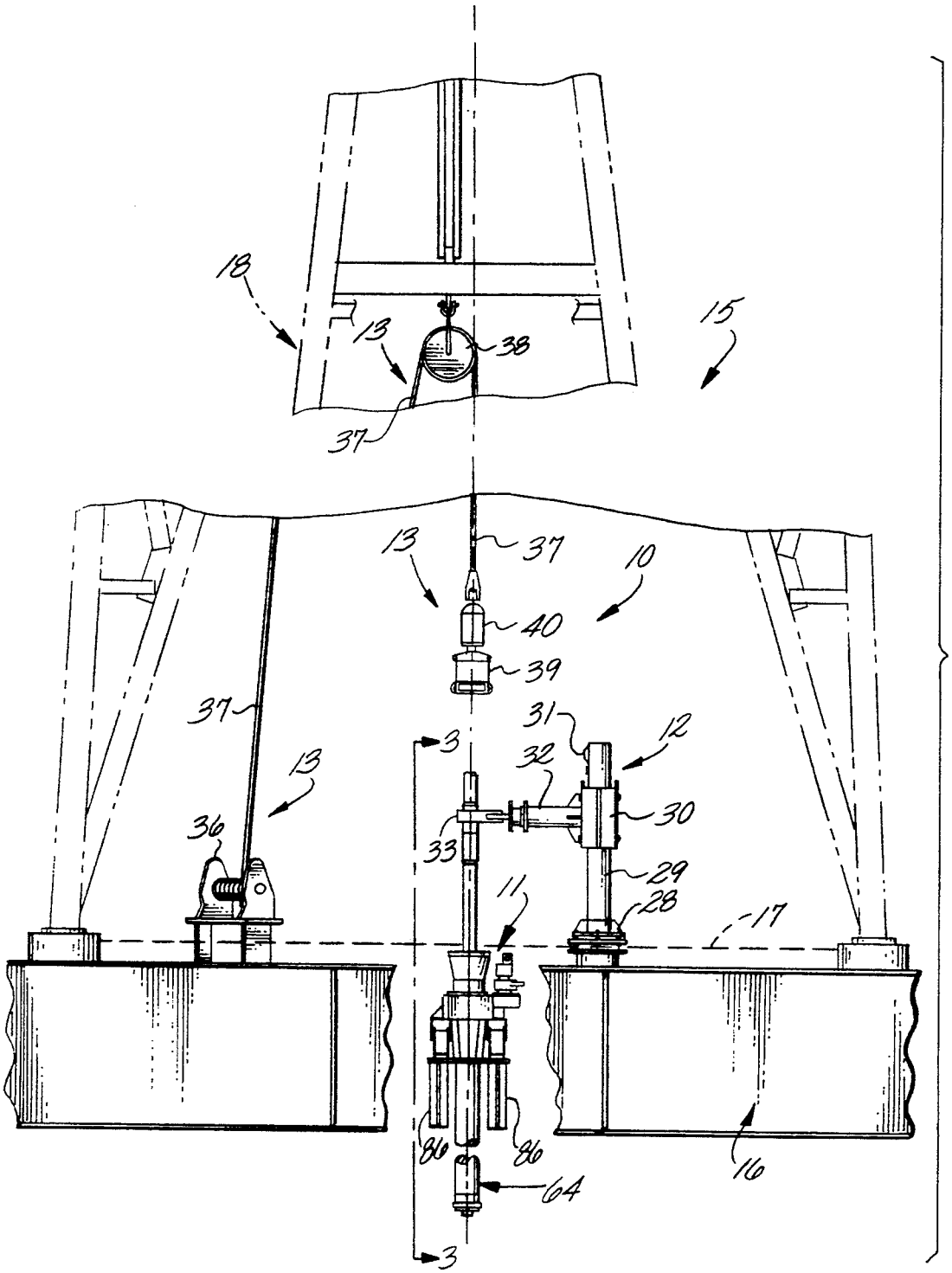
FIG. 1 is a fragmentary elevation view, partially in section and partially in phantom, of a well drilling rig equipped with presently preferred equipment according to this invention.
Figure 2:
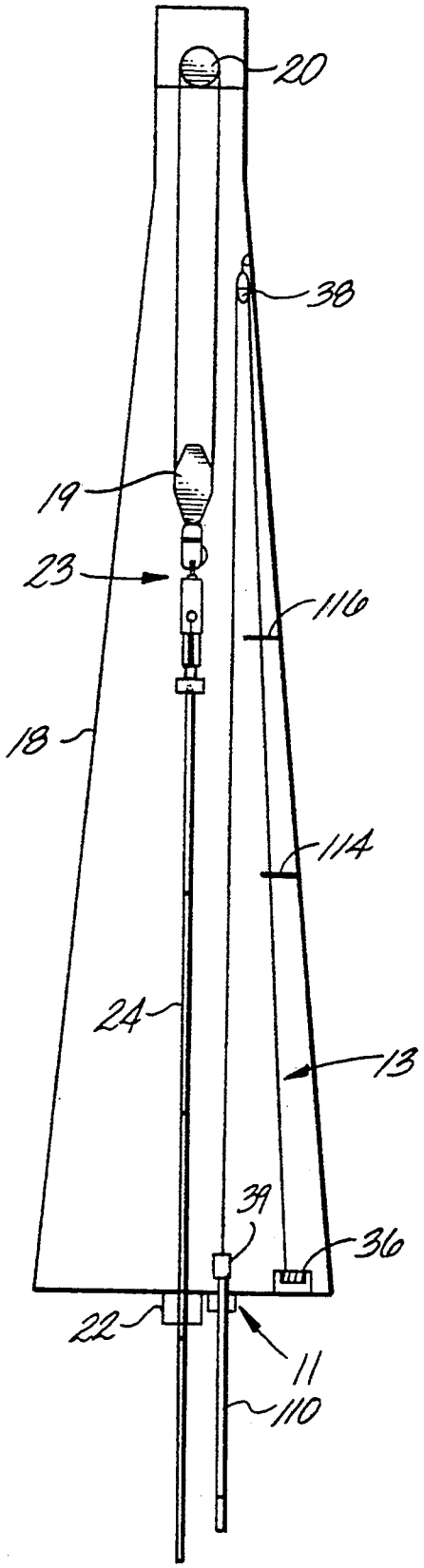
FIG. 2 is a simplified, substantially schematic elevation view, taken in a direction at right angles to that FIG. 1, of the drilling rig which includes a top drive drilling system and the improvements provided by this invention.
Figure 3:
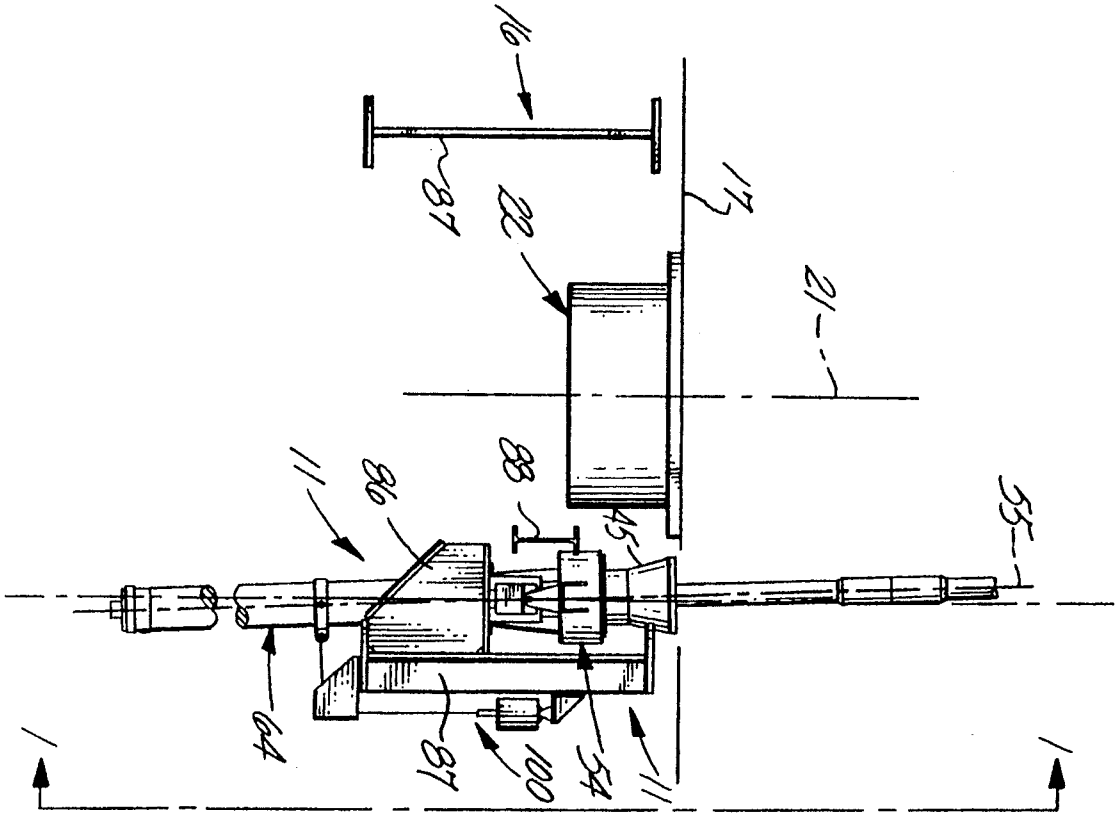
FIG. 3 is a fragmentary elevation view taken along line 3—3 of FIG. 1.

A presently preferred drill pipe stand make-up and breakdown apparatus 10 according to this invention is shown in FIGS. 1 through 14. The principal components of apparatus 10 are a powered rotary mousehole 11, a pipe handling tong assembly 12, and a related hoist system 13. Apparatus 10 is a component of a drilling rig 15 having a rig foundation 16 composed of suitable structural beams suitably interconnected, on top of which a platform working floor 17 is defined as shown in FIGS. 1 and 3. Rig 15 also includes a derrick 18 supported on foundation 16 above floor 17. As shown in FIG. 2, the derrick includes a travelling block 19 which is suspended on suitable cables below a crown block 20 at the top of the derrick for movement along a vertical path which is aligned with the centerline 21 of a well bore which passes through the center of a rotary table assembly 22 disposed in concentric alignment with well bore centerline 21.

The presently preferred usage of apparatus 10 is in an offshore drilling rig, such as a jack-up drilling rig or a floating drilling rig, such as a drill ship or semi-submersible drilling platform. It will be appreciated, however, that the procedures and equipment provided by this invention can also be used to advantage in land-based drilling rigs. For purposes of example and illustration, apparatus 10 is described in the context of its preferred usage in an offshore drilling rig.

As noted above, a benefit provided by this invention is better realization of the advantages which can be obtained by use of drilling procedures which apply rotary power to the upper end of a drill pipe string 24 at a location in the drilling rig above its floor 17 by use of procedures and equipment which do not rely upon the presence of a kelly at the upper end of the drill string. Several kinds of such procedures and equipment are known. Those several kinds of arrangements are collectively referred to herein as drill string direct drive systems to distinguish them from rotary table drive arrangements which apply rotary power to a drill string indirectly via a kelly from a rotary table at the rig floor. The kind of drill string direct drive which has proved most accepted in the industry is that kind known as a top drive drilling system.

Accordingly, a top drive drilling system 23 is carried by and suspended from travelling block 19, either directly from the travelling block as shown in FIG. 2 or, if desired, from a lifting hook (not shown) carried by the travelling block. The top drive drilling system can be a VARCO BJ system manufactured by Varco International, Inc. As is now well known in the drilling industry, top drive drilling systems include a motor and dolly assembly for driving a power swivel to which the upper end of a drill pipe string 24, aligned with well bore centerline 21, can be connected. The drill pipe string extends through rotary table 22, which normally is idle and is not used to turn the drill string during drilling operations conducted by use of the top drive drilling system, and downwardly into the desired well bore. Operation of the top drive drilling system rotates drill string 24 to power a drill bit (not shown) connected to the lower end of the drill string in a known manner. Travelling block 19 normally is guided in and constrained to only vertical motion along a path which is collinear with well bore centerline 21.

Powered mousehole 11 is located in the drilling rig closely adjacent to, and to the side of, rotary table 22. Where the powered mousehole is a component of an offshore drilling rig, the preferred location for the mousehole is forward of the rotary table between the rotary table and a horizontal pipe racking and storage area outside derrick 18. The powered mousehole preferably is disposed in a hole 26 in the rig platform so that the top of the mousehole is located below the platform surface (see FIG. 10) so the hole can be closed by a hatch 27 when the mousehole is not in use.

Tong assembly 12 preferably is located on the platform to the side, port or starboard, of mousehole 11 and includes a base 28 which includes a rotatable mounting for a preferably hollow non-round vertical post 29 to which a carriage 30 is mounted for movement along post 29 but not for rotation about the post. The mass of the carriage and of the equipment carried by it preferably is counterbalanced by counterweights inside the post, which counterweights are connected to the carriage via a cable (not shown) passed over a pulley 31 at the top of the post. A horizontal telescoping arm assembly 32 is mounted to the carriage and, at its end remote from the carriage, mounts a tong jaw assembly 33.

Hoist system 13 is separate from and supplemental to the principal hoist system in derrick 18 which includes travelling block 19. Hoist system 13 preferably includes a winch 36, such as an air driven winch commonly called an air tugger, for reeling in and paying out a cable 37. Cable 37 passes over a sheave or pulley 38 which is suitably suspended in the derrick at a desired, preferably high, location in the derrick. Cable 37 passes from the sheave to its free end to which is connected a pipe elevator 39. The connection of elevator 39 to cable 37 preferably is via a coupling 40 which preferably includes a vertically disposed compression spring (not shown) so arranged in the coupling that the elevator is resiliently connected to cable 37. The installation of hoist system 13 in rig 15 is so arranged that the elevator normally hangs in the rig directly above mousehole 1 I.

The principal component of apparatus 10 is powered mousehole 11. As shown best in FIGS. 8, 9 and 10, the mousehole includes an annular elongate bowl 45 which can be cylindrical at its lower end 46 and which flares upwardly and outwardly toward its upper end 47 which is located below the top surface of platform floor 17 in platform hole 26. An outwardly extending circumferential flange 48 is secured, preferably integrally, to the lower end of the bowl. An annular externally toothed gear ring 49 is secured to the underside of bowl flange 48, as by bolts 44, and serves as the outer race of thrust and journal bearing, such as a deep groove ball bearing, having an inner race ring 50. The inner race ring is secured, as by bolts 51, to a bottom plate 52 of a housing 54 in which the bowl is mounted for rotation about a substantially vertical axis 55. Axis 55 is the active axis of the powered rotary mousehole.

A motor 57 is mounted to an upper top portion of housing 54 and has a driven shaft 58 which is coupled within the housing to a gear train 59, the output gear of which meshes with the teeth of ring gear 49. Thus, operation of motor 57, in one direction or the other, causes bowl 45 to be driven, in one direction or the other, about axis 55 within housing 54. The mount of torque transmitted to bowl 45 during operation of motor 57 is controlled by a torque controller 60 which is associated with motor 57.

Figure 8:
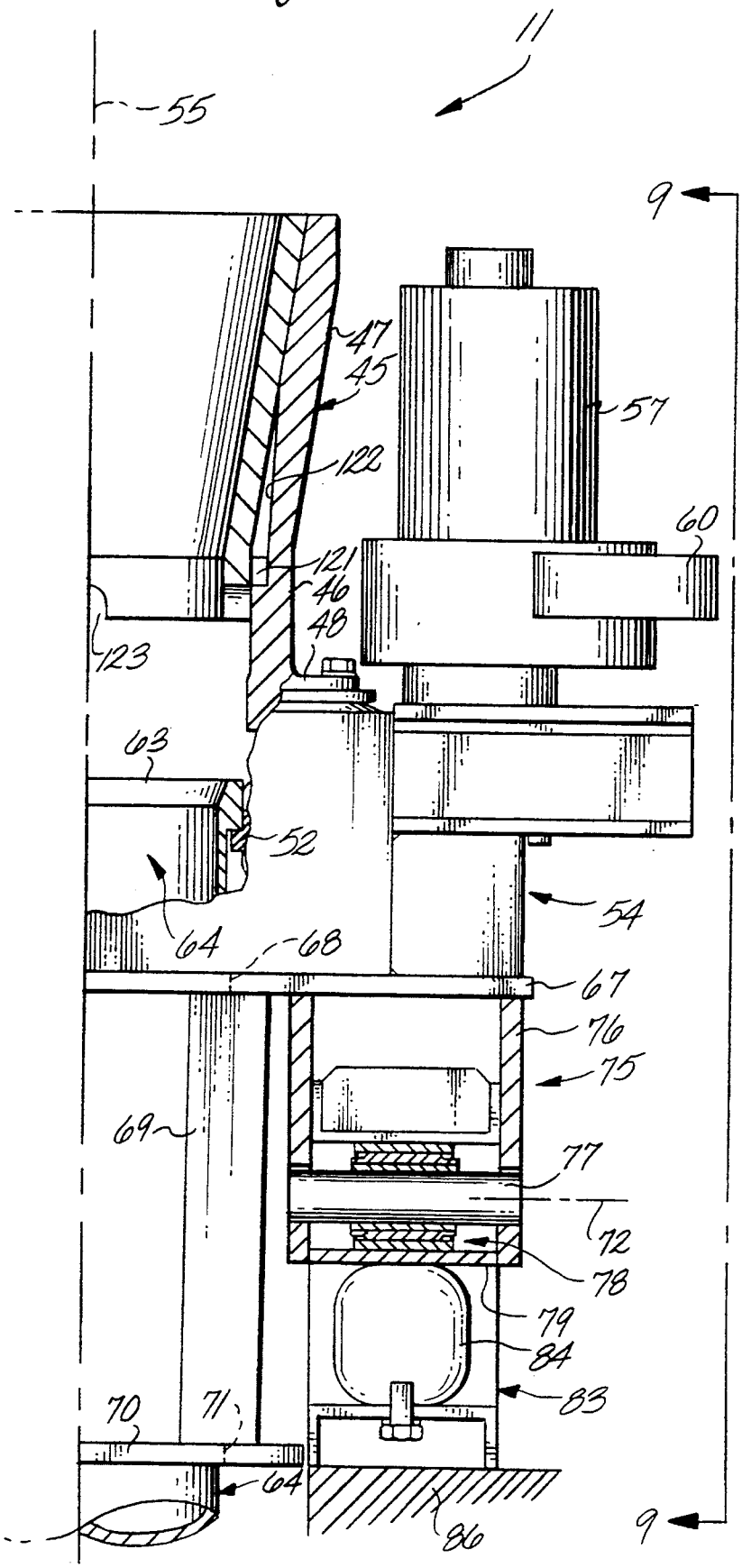
FIG. 8 is a partial elevation view, partially in section, of the rotary mousehole drive and support arrangements according to a presently preferred embodiment of the invention.
Figure 10:
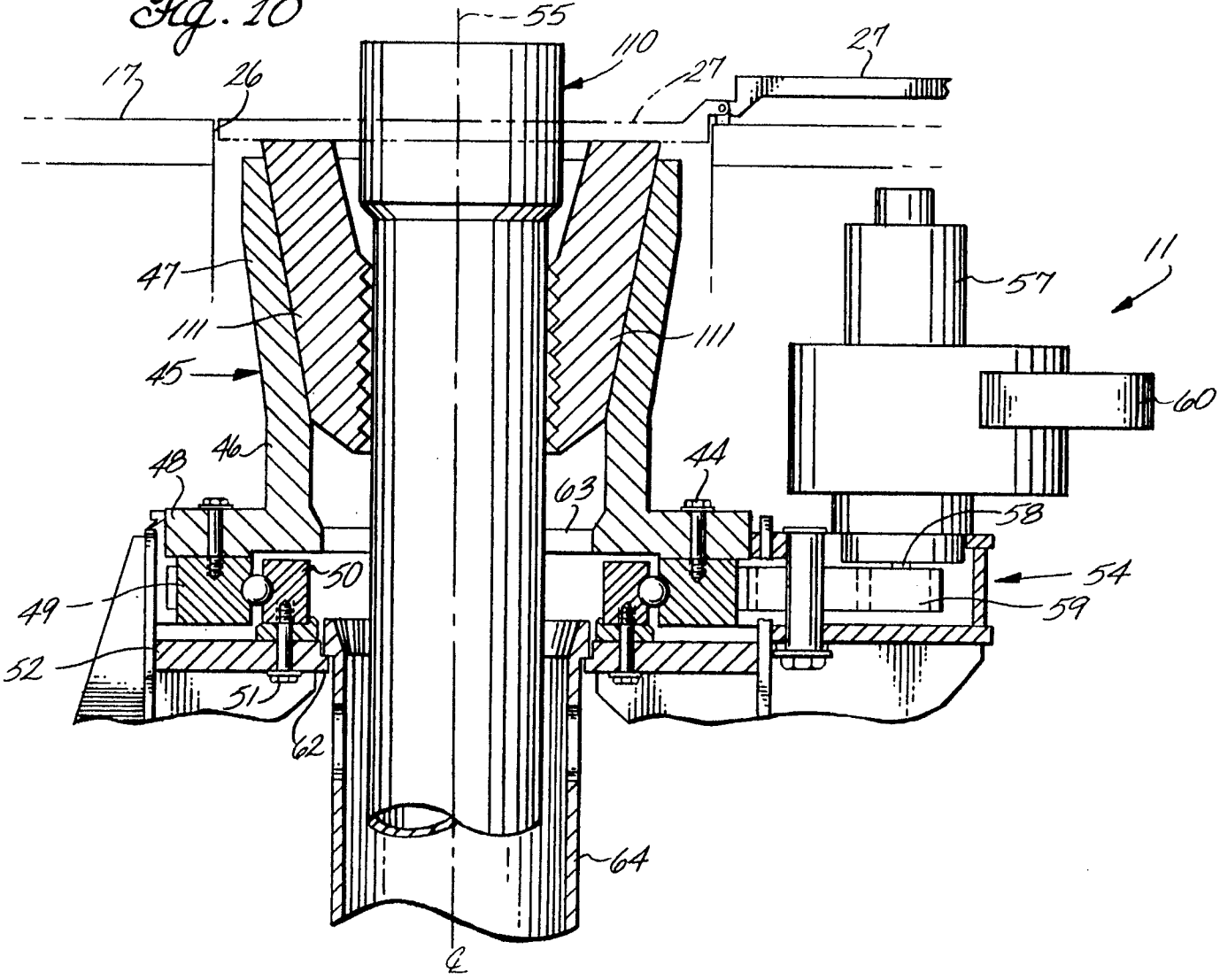
FIG. 10 is a fragmentary elevation view illustrating additional aspects of a portion of the structure shown in FIGS. 8 and 9.
Figure 12:
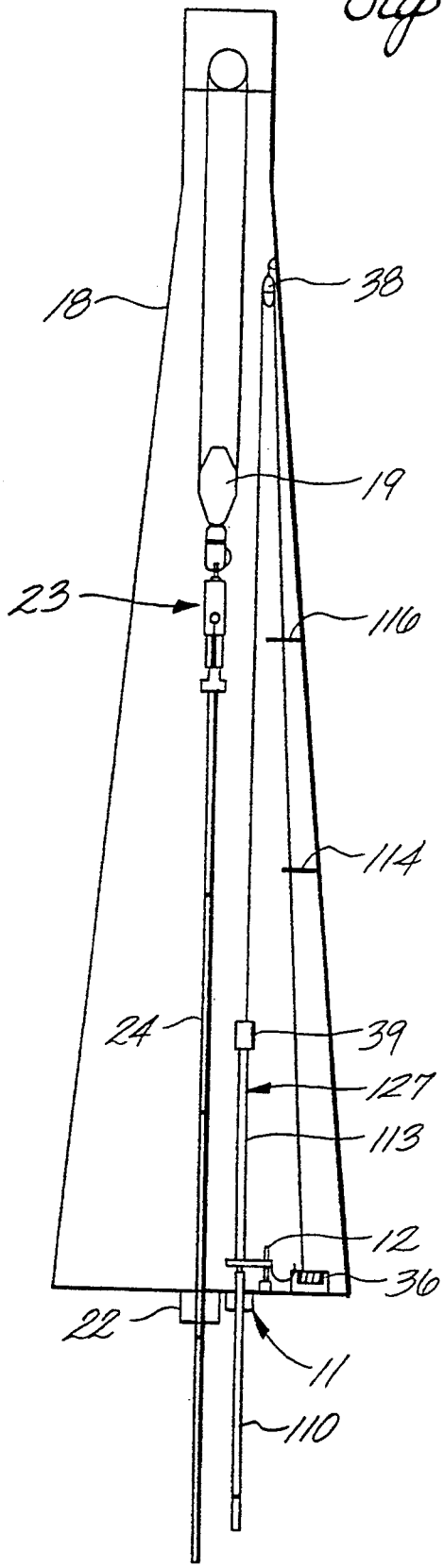
FIGS. 12, 13 and 14 are views similar to that of FIG. 2 which, in combination with FIG. 2, illustrate various steps in the procedure for making up a multi-joint stand of drill pipe during top drive drilling operations.
Figure 13:
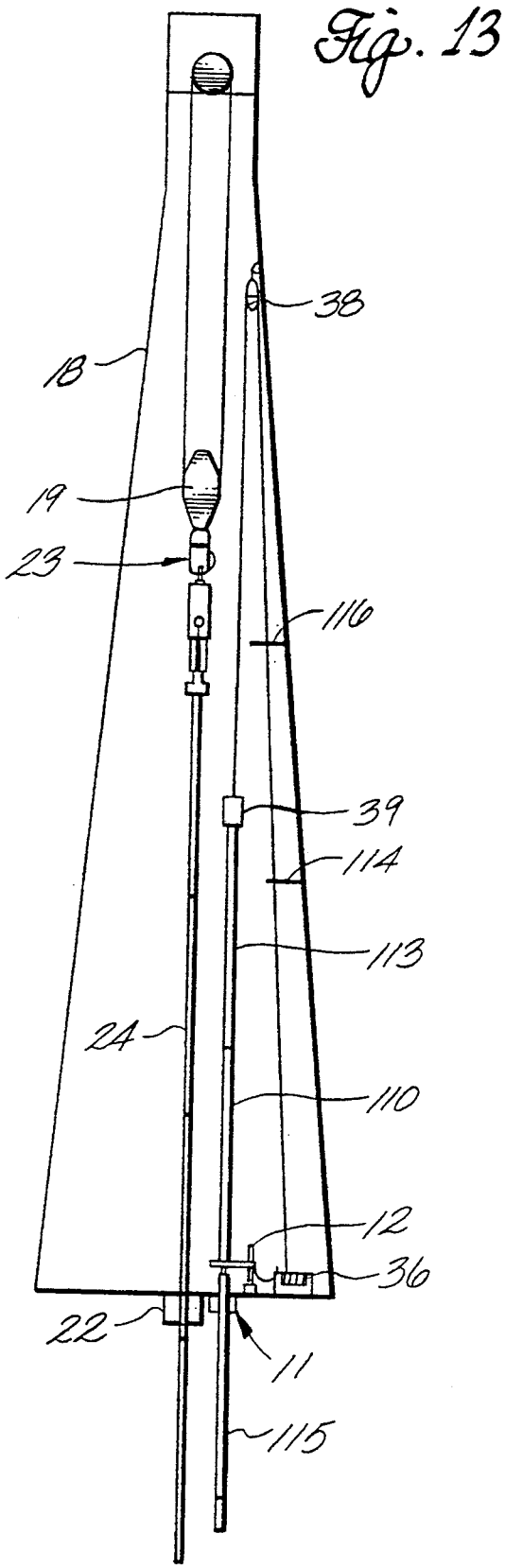

As shown best in FIGS. 8 and 10, the bottom plate 52 of housing 54 has formed therein a hanger hole 62 concentric to axis 55. The upper end 63 of an elongate mousehole scabbard tube 64 is supported by housing bottom plate 52 in hanger hole 62. The scabbard tube preferably is hung, much like a pendulum, from the housing and normally is urged by gravity into a coaxial relation to axis 55. The scabbard tube is provided for receiving and housing the major portion of the length of a drill pipe joint, such as joint 110, received in the mousehole in the manner described below.

Mousehole housing 54 also includes a foundation plate 67 which is below and preferably parallel to bottom plate 52. A hole 68, having a diameter slightly larger than the outer diameter of scabbard tube 64, is formed in the foundation plate concentric to axis 55 to enable the scabbard tube to pass through the foundation plate. Also, a plurality of vertically elongate spacer members 69 are secured to the foundation plate about hole 68 and depend from that plate. The spacer members support a scabbard guide plate 70 below the foundation plate. A hole 71, similar to hole 68, is formed in the guide plate to cooperate closely with the exterior of the scabbard tube which passes through the guide plate. Plates 52, 67 and 70 cooperate with the scabbard tube to define an angularly stiff yet releasable connection of the scabbard tube to the mousehole housing. The scabbard tube can be pulled vertically out of the housing through the bowl 45.

Mousehole housing 54 is mounted, preferably to rig foundation 16, so that the mousehole axis 55 can be tilted out of plumb relation into substantial intersection with the path of vertical movement of travelling block 19 in derrick 18. Tilting of the mousehole occurs about a horizontal tilt axis 72 which preferably is located below mousehole housing 54. Axis 72 is defined by a pair of pivot axles 77 which are located on opposite sides of the scabbard tube below housing foundation plate 67. Each axle is carried in a respective pivot axle mount assembly 75.

Figure 9:
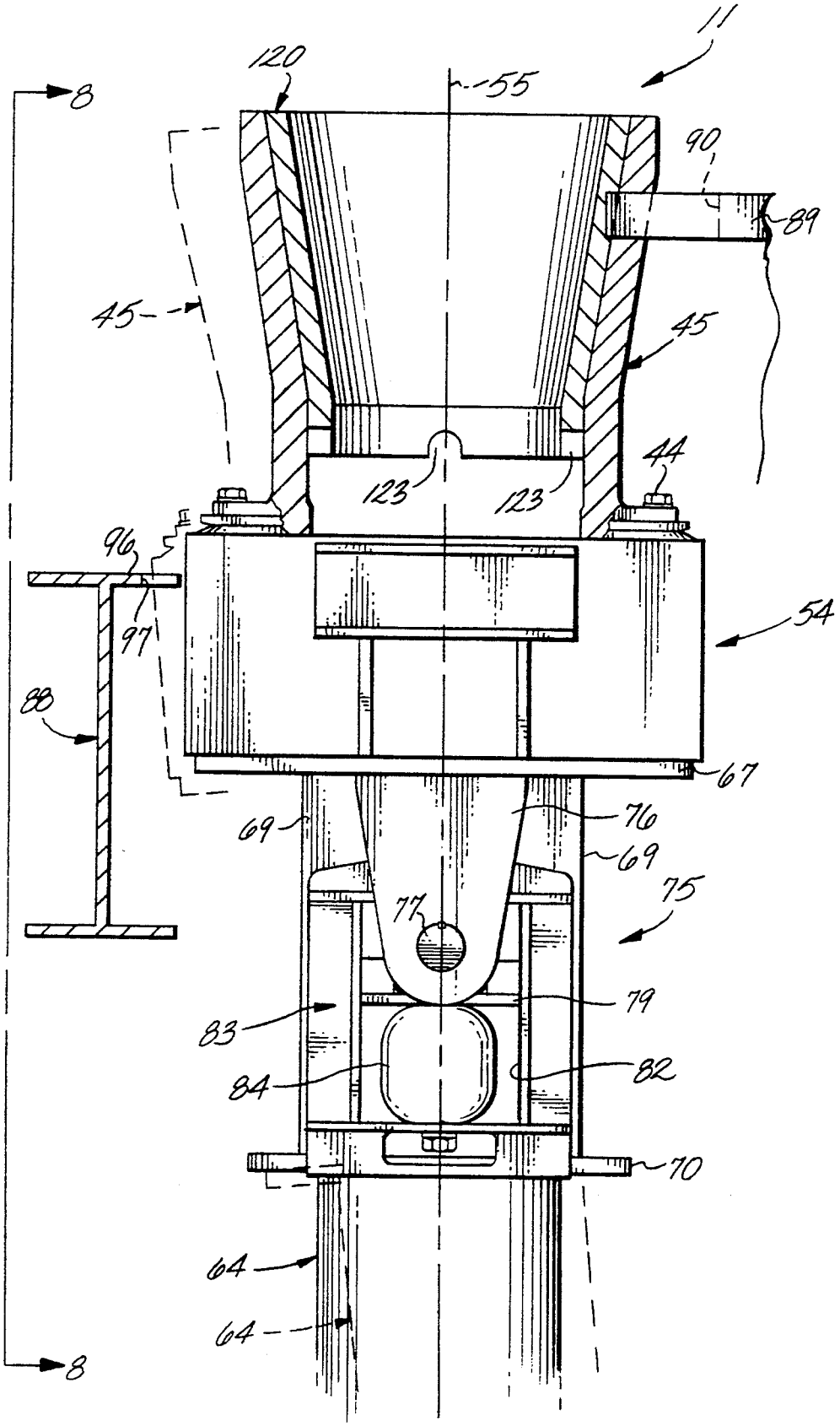
FIG. 9 is an elevation view taken along line 9—9 of FIG. 8.

As shown best in FIGS. 8 and 9, each pivot axle mount 75 is composed of upper and lower bodies which, by virtue of the cooperation between them, are vertically movable relative to each other. Each upper body (see FIG. 8) is comprised of a pair of axle support lugs 76 which are disposed parallel to each other and which depend from the underside of housing foundation plate 67. Adjacent their lower ends, they carry between them a mousehole pivot axle 77 which defines mousehole pivot axis 72. Between the lugs 76, the axle is circumferentially engaged by a journal bearing 78 which is supporting on a bearing carrier 79. The bearing carrier is slidably received in a central aperture 82 of a vertically disposed, substantially rectangular structural frame 83 disposed, in part, between the opposing inner faces of lugs 76. A yieldable support member 84, preferably provided in the form of a block-like rubber shock mount, is engaged between the underside of the bearing carrier and the bottom of the aperture within frame 83. Accordingly, the bearing carrier is yieldably and resiliently supported in frame 83 by yieldable member 84 which is defined to be sufficiently strong to carry the weight of the rotary mousehole and any joints of drill pipe which may be disposed within the mousehole at any time, as well as such additional vertical loads as may be applied to the mousehole in its use.

The upper portion of frame 83 cooperates closely between the inner faces of lugs 76, as shown in FIG. 8. Each frame 83 is supported on a structural support bracket 86 defined within the rig foundation as a part of that foundation. As shown in FIG. 3, existing offshore drilling rigs which include rotary tables, usually include a pair of parallel, deep web structural rotary table support beams 87, between which are disposed a pair of smaller parallel rotary table skid beams 88, one of which is shown in FIG. 3.

Figure 5:
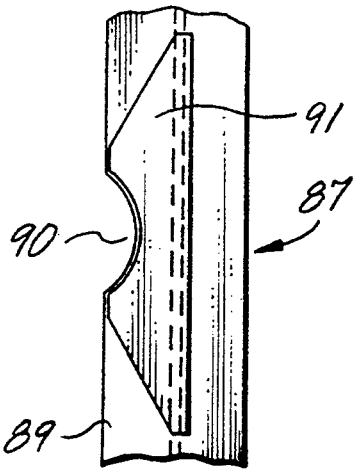
FIGS. 5, 6 and 7, respectively, are fragmentary plan views of the relief and reinforcement of certain of the structural beams depicted in FIG. 3 useful to accommodate the rotary mousehole mechanism shown in FIG. 3 and to enable pivoting of it.
Figure 6:
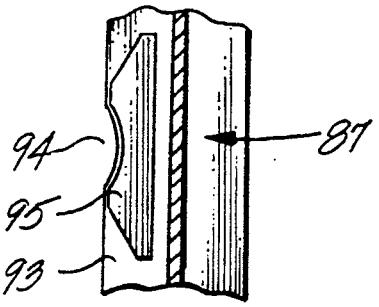
Figure 7:
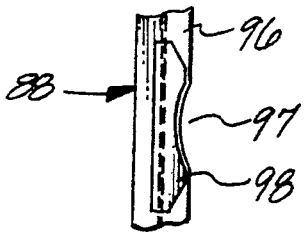

As shown in FIG. 3, a rotary mousehole according to this invention can be installed in an existing offshore drilling rig in association with an appropriate one of the rotary table support beams 87 by affixing, adjacent a lower portion of that beam on the inner face of the web thereof, a pair of mousehole support brackets 86 to respective ones of which mousehole support frames 83 can be connected. To accommodate the mousehole, particularly when it has the structure described above and shown in the drawings, it may be appropriate to provide suitable clearance for the mousehole by relieving portions of the upper and lower flanges of the rotary table support beam to which the mousehole is connected and an upper adjacent flange of the proximate rotary skid beam 88. If that is necessary, those beam flanges are locally recessed and reinforced as shown in FIGS. 5, 6 and 7. In FIG. 5, it is shown that the upper flange 89 of the rotary table support beam 87 is recessed preferably by a relatively smooth curve, as at 90, and a suitable doubler plate 91 is welded to the unrelieved portions of the flange adjacent recess 90 to compensate for the reduction in strength of the beam which would otherwise be experienced by the presence of recess 90 in the beam flange. Similarly, FIG. 6 shows that a lower flange 93 of the rotary table support beam 87 can be relieved, preferably by a smoothly curved notch or recess 94, with compensation for the presence of the recess in flange 93 being obtained by welding a doubler plate 95 to the flange adjacent the recess. Similarly, FIG. 7 shows that an adjacent flange of the rotary table support beam 88 can be relieved preferably by a smoothly curved recess 97, in the flange edge, with compensation for that relief being provided by a suitable doubler 98.

Figure 4:
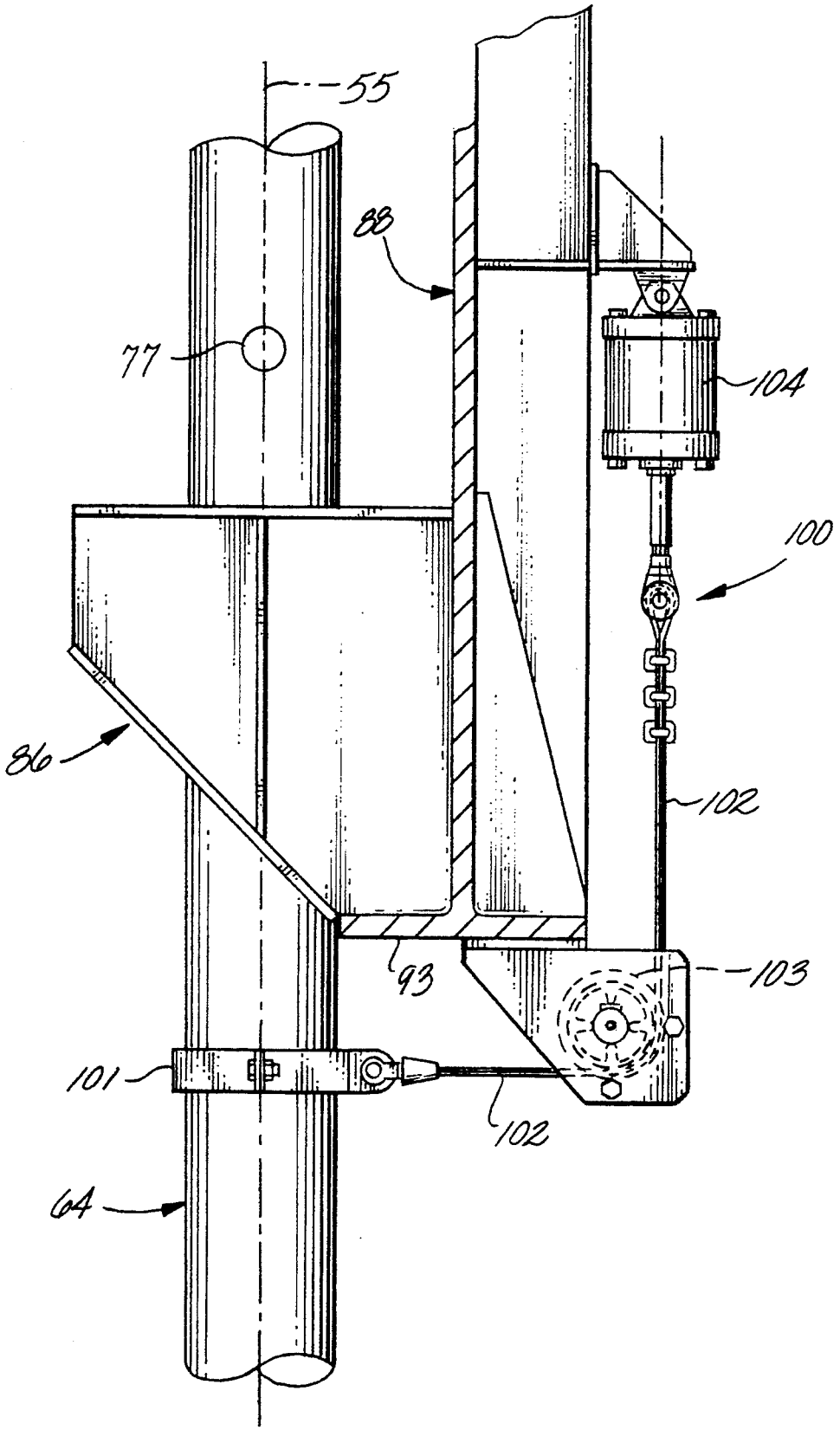
FIG. 4 is an enlarged fragmentary elevation view, partially in section, of a mousehole pivot drive mechanism which is a component of the equipment shown in FIGS. 1 and 3.

Drive means are coupled between the rig foundation 16 and powered mousehole 11 for tilting the mousehole about its tilt axis 72 at times when inclination of the mousehole axis 55 from plumb may be desirable in the course of operations in the drilling rig. The mechanism for producing tilting of the mousehole relative to the rig foundation is shown generally in FIG. 3 and in more detail in FIG. 4. A mousehole tilt mechanism 100 includes a collar 101 which is clamped about the exterior of the mousehole scabbard tube 64 a desired distance below the mousehole tilt axis 77. Preferably the location of the collar is closely adjacent the lower surface of the bottom flange 93 of the rotary table support beam to which the mousehole is mounted in the manner described above. One end of a cable 102 is connected to collar 101 and is passed over a pulley 103 to a vertically acting drive mechanism 104, which preferably is a piston and cylinder assembly, suitably carried on the outside of beam 88 above pulley 103. The pulley can be carried on the bottom outer portion of beam 88 as shown in FIG. 4. In the normal position of mechanism 100, gravity acting upon the pendulum-like mousehole scabbard 64 causes the mousehole axis 55 to be vertical. If tilt of the mousehole is desired, actuator mechanism 104 is operated to pull on cable 102 to draw collar 101 toward pulley 103 and thereby impart the desired angle of tilt of the mousehole within the range of tilt afforded to it. The tilted condition of the mousehole is shown in FIG. 3.

Figure 11:
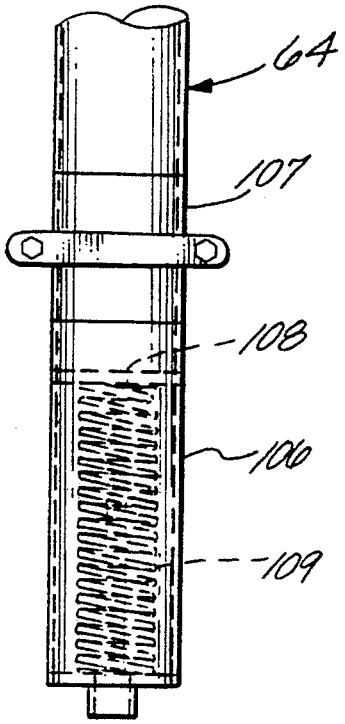
FIG. 11 is a fragmentary elevation view of the lower portion of the mousehole scabbard shown in FIGS. 8, 9 and 10.

FIG. 11 is a fragmentary elevation view of a lower portion of mousehole scabbard 64. The scabbard tube, which has its upper end 63 hung in mousehole housing 54, has connected to its lower end a tubular housing 106 via a coupling 107 which maintains the housing in alignment with the portion of the mousehole scabbard above it, but permits the housing 106 to rotate about the mousehole axis relative to the upper portion of the mousehole. A plunger disc 108 is slidably disposed within the inside of housing 106. The disc preferably is carried at the upper end of a compression spring 109 which has its lower end supported by the substantially closed lower end of housing 106. Spring 109 is a heavy duty compression spring which is rated for loads in the range of from 600 to about 6000 lbs. Spring 109 is a component of a resiliently yieldable support for one or more drill pipe joints which may be received in the mousehole scabbard at different times during use of mousehole 11. Alternatively, if desired, the lower end of the scabbard tube can be effectively continuous with, and not rotatable relative to, the upper portions of that tube, and disc 108 can be rotatably carried by the upper end of spring 109. In either event, rotation of a pipe joint in the scabbard tube is accommodated at the lower end of the scabbard in a way which protects the joint pin, and also the scabbard itself, from undesired wear.

FIGS. 2, 12, 13 and 14 illustrate conditions at different stages in the course of makingup a thribble (three-joint) stand 126 of drill pipe in derrick 18 during the performance of drilling operations through rotary table 22 by use of top drive drilling system 23. A first joint 110 of drill pipe to be assembled into a multi-joint stand is engaged at its box end by elevator 39 of hoist system 13. Hoist system 13 is operated to lower joint 110 into mousehole 11 until its box end is at a desired position closely above the top of mousehole bowl 45. Joint 110 is secured in the mousehole by engaging suitable slips 111 (see FIG. 10) in a known manner between the mousehole bowl and the joint below its box to hold joint 110 from further downward movement in the mousehole. The slips cooperate between the bowl and the exterior of the joint to transfer to the joint torque applied to the bowl by operation of motor 57. The joint is resiliently and yieldably supported on the spring mechanism provided at the lower end of the mousehole scabbard (see FIG. 11) before slips 111 are engaged with the joint and the mousehole bowl.

A second joint 113 of drill pipe is then engaged adjacent its box end by elevators 39 and is lowered toward joint 110 in the mousehole. As the lower pin end of joint 113 approaches the upper end of joint 110, the lower portion of joint 113 above its pin is engaged in the jaws 33 of tong assembly 12 to cause the pin end of joint 113 to properly align with and engage with the box end of joint 110 during the last increments of downward motion of joint 113 which then is co-axially aligned with mousehole axis 55. The cooperation of the tong jaw assembly with the lower end of joint 113 holds that joint from rotation about mousehole axis 55. However, in view of the above described nature of the tong assembly, the tong assembly yieldably holds the lower end of joint 113 so that it can move further downwardly without significant resistance along post 29 as mousehole 11 is operated to rotate joint 110 about axis 55 thereby to cause the threads between the cooperating pin and box ends of joints 113 and 110 to thread together with the desired amount of torque. It will be recalled that it is preferred that the connection of elevators 39 to cable 37 is a resilient connection and so joint 113 can be drawn down into fully threaded engagement with joint 110 against the spring biased support for joint 113. When joints 113 and 110 have been threaded together, the two joint double stand 127 is withdrawn from the mousehole and set aside temporarily in a doubles racking board 114 provided at a suitable elevation in derrick 18.

Figure 14:
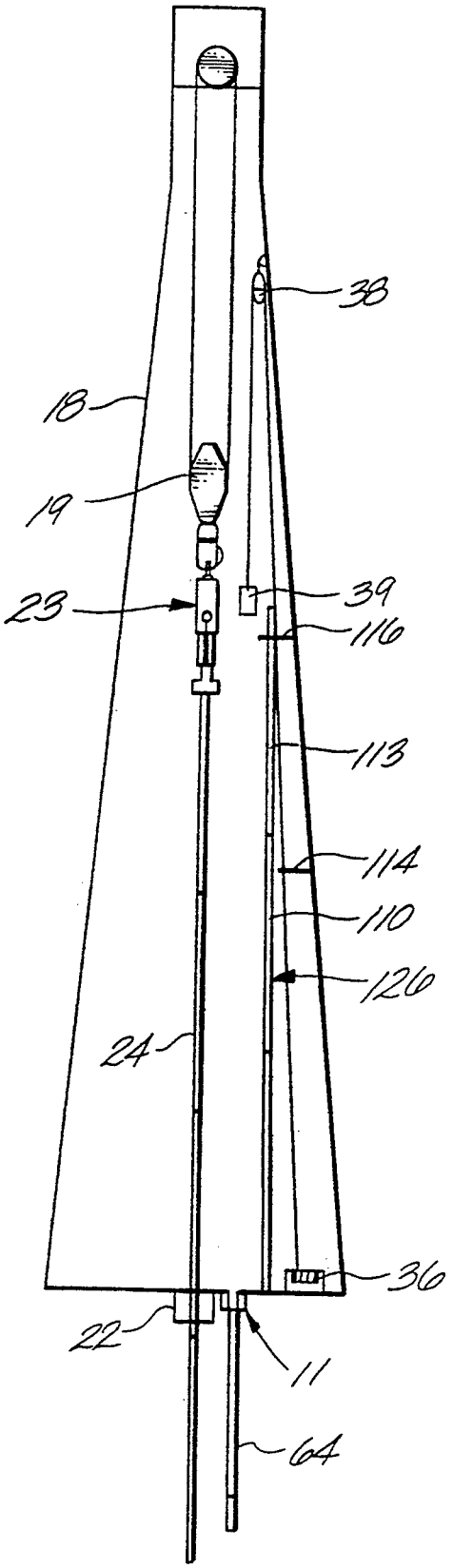

A third joint 115 of drill pipe is then acquired by elevators 39 of hoist system 13 and is lowered into the mousehole which is now empty. Joint 115 is secured by slips 111 into the mousehole in the manner described above. The doubles stand 127 (composed of assembled joints 113 and 110) is then recovered by elevators 39 from the doubles racking area within derrick 18 and is lowered into engagement with the box end of joint 115 in the mousehole. This is accomplished by use of tong assembly 12 in the manner described above. (see FIG. 13). The double stand 127 is assembled to the third joint of the desired thribble stand with the desired amount of torque by operation of the mousehole in the manner described above. The completed thribble stand 126 of drill pipe (composed of joints 113, 110 and 115) can then be racked vertically in the derrick by use of a thribbles racking board 116 as shown in FIG. 14. The operations described above and illustrated in FIGS. 2, 12, 13 and 14 can be performed during drilling operations performed by use of a drill string 24 disposed in the well bore and operated by top drive drilling system 23.

During the performance of drilling operations by use of rotary table 22, rather than top drive drilling system 23, mousehole 11 can be tilted, in the manner described above, toward the rotary table to serve as an active or passive mousehole in support of rotary table drilling operations.

FIG. 10 shows slips 111 interposed directly between the interior of bowl 45 and the exterior of drill pipe joint 110 below the box end of that joint. The situation as shown in FIG. 10 is that which can occur where the drill pipe joint is of relatively large diameter. If a drill pipe joint is of smaller diameter, a suitable mousehole bowl insert 120 (see FIGS. 8 and 9) can be used with the bowl to, in effect, reduce the inner diameter of the bowl to a diameter with enables slips 111 to be used with a smaller diameter pipe joint. The bowl insert 120 preferably is a sleeve which flares outwardly and upwardly along at least the major portion of its length with the same degree of flare as the inner walls of bowl 45. The difference between the inner and outer diameters of the sleeve is defined to adapt the bowl for use with a pipe joint having an outer diameter within a specified range of diameters. As shown in FIGS. 8 and 9, when the insert sleeve is inserted into bowl 45, the outer surfaces of the sleeve register with the inner surfaces of the bowl so that the upper ends of the insert and the bowl are substantially coplanar. To assure that the insert will rotate with the bowl and not slip relative to the bowl as the bowl is rotated about axis 55, the insert sleeve can carry, preferably adjacent its lower end, one or more outwardly extending projections 121 which cooperate in corresponding grooves 122 defined in the inner wall of the bowl. The projections and grooves cooperate as keys and keyways to secure the insert from turning about axis 55 relative to the bowl. If desired, a plurality of downwardly open, semi-circular recesses 123 can be provided in the bottom end of the insert to cooperate with a suitable tool useful for extracting an insert sleeve from the mousehole bowl.

Referring to FIGS. 15 through 18, a drill pipe make-up and break-out tool 130, according to another embodiment of this invention, comprises an upper housing 131 which is supported on a lower housing 132 by a plurality of spring biased legs 133. The lower housing has a plurality of spring biased legs 134.

The upper housing preferably comprises a reversible rotatable jaw 135 in an enclosure 137 suitable for rotating a pipe 138 having a coupling end 139 with threads 140 known in the art as "pin". A motor 141, such as a hydraulic motor, provides motive force to the jaw 135.

The lower housing 132 preferably comprises a fixed (non-rotatable)jaw 142 in an enclosure 143 suitable for holding immobile a pipe 144 under a radial force; the jaw 142 releasably grips the pipe. In an alternative arrangement, the jaw 142 can be rotatable. The lower housing 132 includes a releasable back-up plate 145 having an aperture suitable for retaining the pipe 144 suspended therefrom at a neck 146 formed in the pipe 144 in an absence of gripping force from the jaw 142. The neck 146 is formed by increasing a diameter of the coupling end 147 of the pipe 144, known in the art as a tool joint "box". Design and operation of such pipe gripping jaws 135, 142, as well as back-up plate 145, are well known in the art. Further details regarding the jaws 135, 142 and the back-up plate 145 may be found in Kennard which is hereby incorporated herein by reference.

The tubular upper housing legs 133 comprise an upper leg section 136 having a distal enclosure portion 149 for a spring 150. The upper leg distal portion 149 is in telescoping engagement with a lower leg section 151. Compression of the spring 150 preferably allows the upper leg section 136 to travel a suitable distance in the lower leg section 151. The upper leg section 136 is preferably secured to upper housing by support plates 153. The lower leg section 151 is preferably secured to the lower housing 132 by either support plates 154 or 155 depending upon a spatial arrangement of legs 133 on the upper housing 131.

The tubular lower housing legs 134 comprise an upper leg section 156 having a distal enclosure portion 157 for a spring 152. The lower housing upper leg distal portion 157 is in telescoping engagement with a lower leg section 158. Compression of the spring 152 preferably allows the upper leg section 157 to travel a suitable distance in the lower leg section 158. The upper leg section 157 is secured to the lower housing 132. The lower leg section 158 is preferably secured to the upper leg section 156 by means of a support plate 159.

Figure 15:
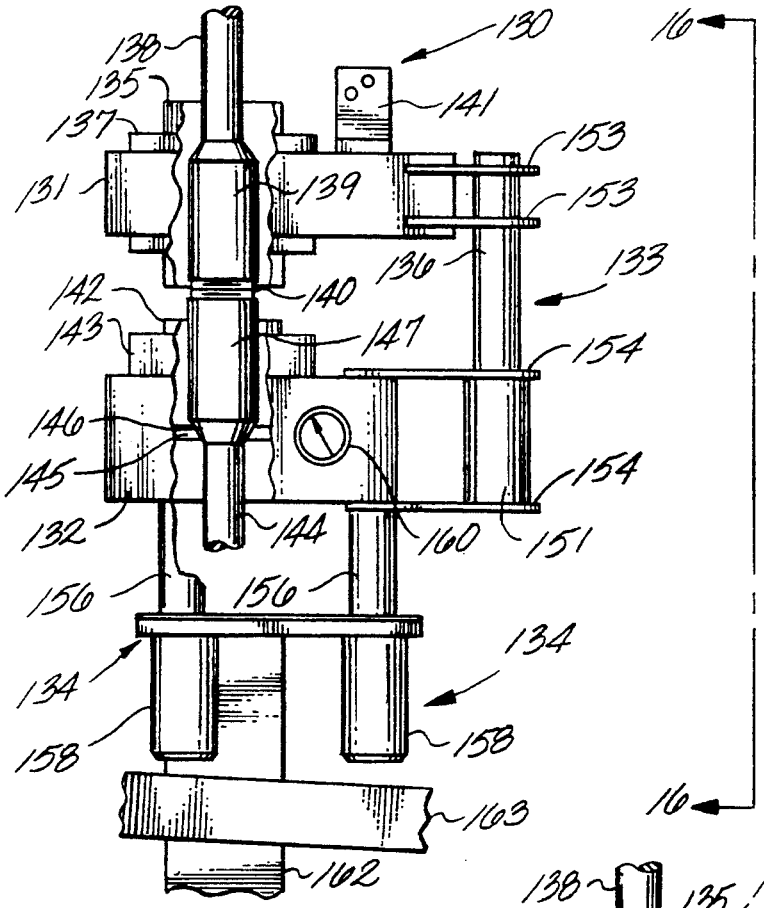
FIG. 15 is an elevation view, with certain portions broken away, of another pipe stand make-up and breakdown rotary mousehole mechanism according to this invention.
Figure 16:
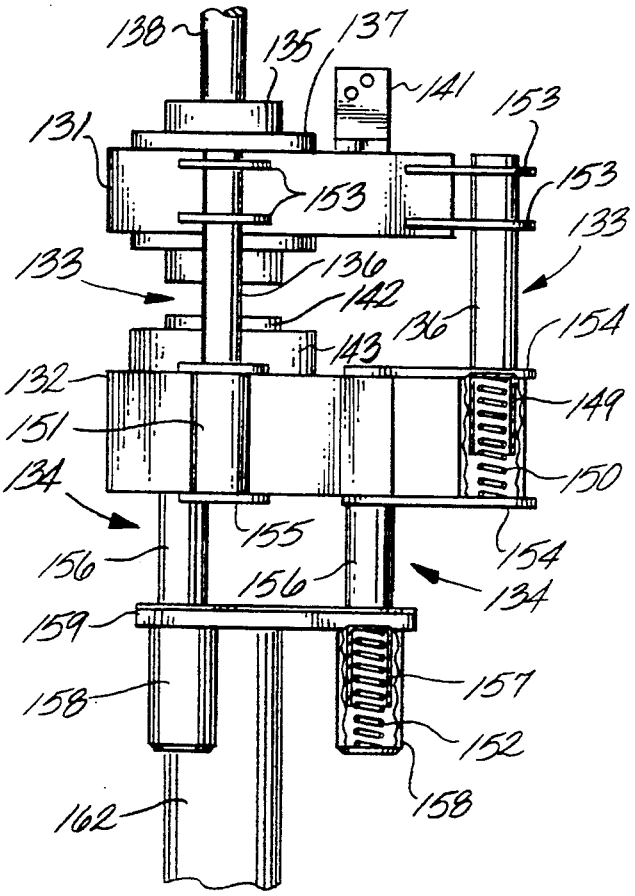
FIG. 16 is a view, partially in section, taken along line 16—16 in FIG. 15.
Figure 17:
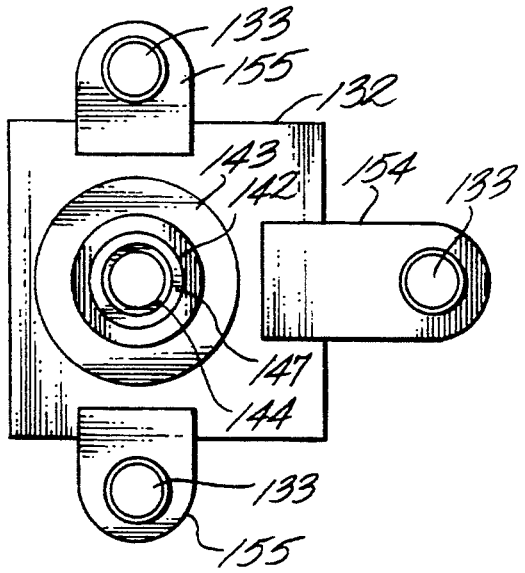
FIG. 17 is a bottom view of the mechanism shown in FIG. 15.
Figure 18:
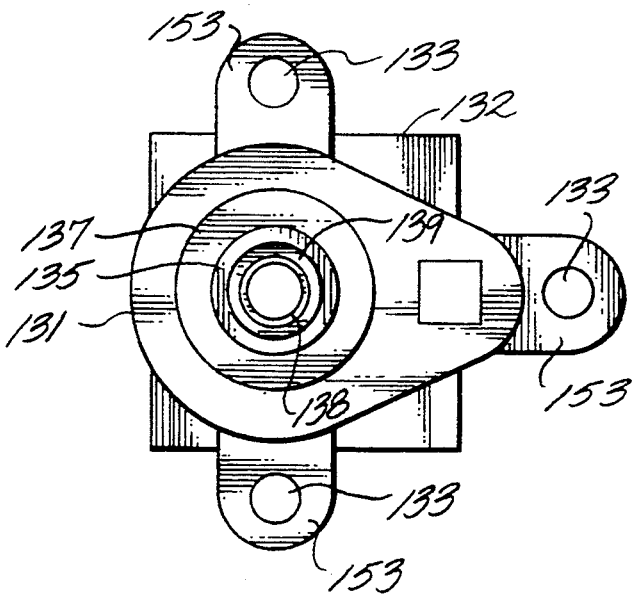
FIG. 18 is a top view of that same mechanism.

In a preferred device of the kind shown in FIGS. 15 through 18, the lower housing 132 has a torque gauge 160 for ascertaining the torque applied by the rotatable jaw 135 on the pipe 138. A commercially available torque gauge for this purpose is disclosed in the aforementioned U.S. Pat. No. 3,293,959 to Kennard. The tool 130 threadably joins one section of drill pipe to another. In operation, lower housing 132 of the tool 130 is positioned on the spring bias legs 134 over a mousehole 162 or other aperture of suitable depth in a platform 163. As shown in FIGS. 15 and 16, the lower housing 132 can be connected to the upper end of a mousehole via support plate 159. The bottom drill pipe 144 is lowered box side up through the upper and lower jaws 135, 142 by a hoist (not shown) to position the neck 144 of the box 147 adjacent the back-up plate 145. The length of the pipe is received by the mousehole 162. The back-up plate 145 is then closed under the neck 146, thereby retaining the pipe 144. The lower jaw 142 is clamped on the box 147 of pipe 144 to inhibit rotation thereof. The top pipe 138 is similarly hoisted and lowered into the upper jaw 135 of the upper housing 131, wherein the pin 139 is clamped by the jaw 135. To facilitate proper alignment of the complementary threads 140 of the pin 139 with the threads of the box 147, spring biased legs 132, 134 allow for lateral, longitudinal and angular play in the upper and lower housings 131, 132. Activation of the jaw rotating motor 141 in a proper direction of rotation (generally clockwise) joins the pipes 138, 144 by threading the pin 139 into the box 147.

To release the joined pipe, the upper and lower jaws 135, 142 are unclamped and the back-up plate 145 is opened. The double, for example, may be hoisted for use in the drill string. An additional joint may be added to make a thribble. A double can be lowered further into a mousehole having sufficient depth so that the box end of the top joint is held at the backup plate 145 in the lower housing and another single can be joined to the double as previously mentioned above. Alternatively, especially where the mousehole is not deep enough to receive the double, the double can be hoisted and set aside while a single is lowered into the tool 130 so that the box end is held at the back-up plate 145. The double is then joined to the single as described above. The tribble, once made, is stored in the derrick for immediate use or back in the finger board until needed. The upper end of the thribble is typically attached to the top drive assembly sufficiently high in the derrick, e.g., at least 90 feet, so that the lower end of the thribble can be attached to the drill string which typically is held in slips in the floor of the drilling platform, such as in the collar of a rotary table which may be is present but is not used during top drive drilling operations.

In tool 130, the pipe 144 as mentioned previously, is held immobile by the lower jaw 142. Consequently, the top pipe 138 is drawn toward the bottom pipe 144 as the pin 139 is threaded into the box 147. Longitudinal travel between the upper housing 131 with respect to the lower housing 132, typically about 5 inches, is taken up by compression of the springs 150 in the legs 133 of the upper housing 132.

The breakout procedure for double or tribble lengths of pipe reverses the make-up procedure described above. The thribble, for example, is lowered into the jaws 135, 142 of tool 130 which is positioned over the mousehole 162 until the box portion neck 146 of the bottom or middle joint (depending on the mousehole depth) is adjacent the back-up plate 145 which is closed. The jaws are clamped to the pipe and the top joint is broken out by operating the rotating jaw 135 in a direction (usually counter-clockwise) suitable for unthreading the top joint. The upper jaw 135 is unclamped and the released joint is hoisted away. The remaining double length is then positioned so that the bottom joint box is held by the back-up plate 145 and the top joint is unthreaded.

The foregoing descriptions of the presently preferred procedures and structures according to this invention has been presented by way of example, rather than as an exhaustive catalog of all procedural and structural forms which this invention may take. Workers skilled in the art to which this invention pertains will appreciate that variations in the procedures described above, and modifications of the structures described above, can be used to implement the advances provided by this invention without departing from the scope of the invention. For that reason, the following claims are to be interpreted and applied liberally in the fair context of the preceding descriptions and of the relevant state of the art.

What is claimed:

1. A method for making up, in a well drilling rig having a platform beneath a derrick in which a hoist is movable along a vertical path above a well bore, a drill pipe stand comprised of plural individual lengths of drill pipe having cooperating pin and box threaded coupling moieties at their opposite ends, comprising the steps of:

a) engaging a first pipe length adjacent the box end thereof in a yieldably supported drivable pipe rotating device in vertically supported torque-transmitting relation to the device for rotation about a substantially vertical axis passing through a hole in the platform adjacent the well bore with the first pipe length below the device in essential alignment with said axis, b) lowering the pin end of a vertically disposed second pipe length along the axis into essentially aligned engagement with the box end of the first pipe length, c) holding the second pipe length from rotation about the axis while yieldably supporting the second length for limited movement along the axis, d) driving the device to rotate the first pipe length about the .axis in a direction causing the pin and box ends of the first and second pipe lengths to thread together to form a drill pipe stand, and e) releasing the stand from movement constraints associated with tire driving step, wherein the yieldably supporting operations afford limited longitudinal, lateral and angular play of the pin and box ends of the two pipe lengths relative to each other before and during performance of the driving step.

2. The method according to claim 1 wherein the pipe rotating device is located in the hole below the platform surface.

3. The method according to claim 2 including mounting the device for pivoting movement between positions in which the axis is disposed vertically and in which the axis substantially intersects the hoist path of movement.

4. The method according to claim 3 wherein the step of engaging the first pipe includes disposing the pipe length in a tubular scabbard connected to the device.

5. The method according to claim 4 including applying a force to the scabbard to move the axis of the scabbard and the device against the bias of gravity between said positions of the axis.

6. The method according to claim 1 wherein the drilling rig includes a drill string direct drive system carried by the hoist and wherein the steps of the method can be performed during operation of the direct drive system to drill the well bore.

7. The method according to claim I including limiting the torque applied to the first pipe length in performance of step d).

8. A method for making up, in a well drilling rig having a platform beneath a derrick in which a hoist is movable along a vertical path above a well bore, a drill pipe stand comprised of plural individual lengths of drill pipe having cooperating pin and box threaded coupling moieties at their opposite ends, comprising the steps of:

a) supporting a drivable annular pipe rotating member for rotation about a substantially vertical axis in a hole in the platform adjacent the well bore, b) engaging a first pipe length adjacent the box end thereof in the annular member in vertically supported torque-transmitting relation to the member with the first pipe length below the annular member in essential alignment with said axis, c) moving the pin end of a vertically disposed second pipe length along the axis into essentially aligned engagement with the box end of the first pipe length, d) holding the second pipe length from rotation about the axis while yieldably supporting the second pipe length for limited movement along the axis, and e) rotating the annular member about the axis in a direction causing the pin and box ends of the first and second pipe lengths to thread together to form a drill pipe stand.

9. The method according to claim 8 including attaching the stand to a drill pipe string in the well bore, and tilting the axis so that it substantially intersects the path above the well bore.

10. The method according to claim 8 including limiting the torque applied to the annular member in performance of step e).

11. A method for making up a section of drill pipe, comprising the steps of:

a) positioning a lower housing on spring-biased legs in alignment with a hole in a drilling platform;

b) positioning an upper housing on spring-biased legs over said lower housing;

c) releasably attaching a lower end of a cable to a box end of a first drill pipe joint;

d) suspending said first drill pipe joint from said cable and inserting said first drill pipe through said lower housing;

e) receiving said box end of said first drill pipe joint with jaws in said lower housing;

f) releasing said lower end of said cable from said first drill pipe joint and attaching a lower end of the same or a different cable to a box end of a second drill pipe joint;

g) suspending said second drill pipe joint from said same or different cable and inserting a pin end of said second drill pipe joint into said upper housing in engagement with said box end of said first drill pipe joint;

h) securing said pin end in jaws in said upper housing;

i) rotating said jaws in said upper and lower housings with respect to each other to thread said pin end of said second drill pipe into said box end of said first drill pipe joint, wherein longitudinal movement between said jaws in said upper and lower housings is taken up by said springs between said upper and lower housings to form a section of joined pipe; and j) releasing said jaws in said upper and lower housings and removing the joined pipe section therefrom.

12. The method of claim 11, wherein said jaws in said lower housing are fixed and said jaws in said upper housing are rotated in step i).

13. The method of claim 11, wherein said steps c) through j) are repeated with a third drill pipe joint as said first drill pipe and with a double joined pipe section as the second drill pipe joint to make a thribble.

14. The method of claim 11, wherein said threading in step i) is to a predetermined torque.

15. A make-up and breakout tool, comprising:

a lower housing and an upper housing disposed above said lower housing, each housing having a set of jaws for gripping pipe;

a first set of spring-biased legs for supporting said lower housing on a platform having a hole formed therein, wherein said hole is aligned with said jaws in said lower housing to receive a first pipe depending from said lower housing;

a second set of spring-biased legs supporting said upper housing on said lower housing with each set of jaws in alignment, wherein said spring-biasing of said leg sets allows longitudinal, lateral and angular play of said jaw sets with respect to each other and said hole;

means for releasably positioning a lower end of a second pipe in said jaws of said upper housing in engagement with an upper end of said first pipe held in said jaws of lower housing; and means for rotating one of said jaw sets with respect to the other set to threadably connect said first and second pipes, wherein travel is taken up by compression of said springs between said upper and lower housing.

16. The apparatus of claim 15, further comprising a torque gauge for ascertaining an amount of torque supplied by said rotating jaw.

17. Apparatus useful for making-up and breaking down multi-joint stands of drill pipe in a well drilling rig concurrently with the performance of drilling operations in the rig which includes a well bore location vertically below a travelling block moveable along a vertical path in a derrick disposed over the working surface of a drilling platform supported on a foundation, the apparatus comprising:

an annular sleeve disposed in the platform working surface adjacent the well bore and mounted for rotation about a substantially vertical axis while carrying a load acting downwardly along the axis, the sleeve being adapted to receive therein substantially along the axis a first joint of drill pipe having a box end thereof disposed above the sleeve and extending substantially along the axis to a lower pin end of the joint, a driver coupled to the sleeve operable for rotating the sleeve in a selected direction about the axis, a mount yieldably supporting the sleeve and the driver on the foundation for limited movement in selected directions relative to the axis, pipe engaging means disposed above the sleeve operable for releasably engaging a second joint and for holding a second joint from rotation while affording vertical movement of a second joint substantially along the axis.

18. Apparatus according to claim 17 wherein the sleeve is disposed below the platform working surface in a hole in the platform.

19. Apparatus according to claim 17 including a tube extending from the mount along the axis in a direction away from the sleeve for receiving a pipe joint engaged in the sleeve.

20. Apparatus according to claim 19 in which the tube has a substantially closed end remote from the sleeve, and means in the tube at said end for resiliently supporting a pipe joint received in the tube.

21. Apparatus according to claim 20 wherein a portion of the tube adjacent its closed end is rotatable about the axis.

22. Apparatus according to claim 19 wherein the mount is defined to enable the axis to be tilted in a selected direction relative to the foundation.

23. Apparatus according to claim 22 in which the selected direction is defined to enable the axis to substantially intersect the path of movement of the travelling block.

24. Apparatus according to claim 22 including a powered tilting mechanism operable for tilting the axis.

25. Apparatus according to claim 24 wherein the tilting mechanism is operatively coupled to the tube.

26. Apparatus according to claim 17 wherein the mount defines a second axis about which the first axis is tiltable in a selected direction.

27. Apparatus according to claim 26 wherein the mount yieldably supports the sleeve and the driver at a location in the mount below the second axis.

28. Apparatus according to claim 17 including hoist means in the derrick substantially above the sleeve operable for lowering, into substantially aligned engagement with a first joint received in the sleeve, the pin end of a second joint of drill pipe.

29. Apparatus according to claim 28 wherein the hoist means comprises a cable and resiliently deflectable means interposed between the cable and a pipe joint supported by the hoist means.

30. Apparatus according to claim 28 wherein the pipe engaging means is disposed in the rig for movement into and out of position above the sleeve.

31. Apparatus according to claim 28 wherein the pipe engaging means comprises a jaw assembly operable for clamping engagement with a pipe joint, the jaw assembly being mounted to be secure from rotation about the axis and to be substantially free to move along the axis.

* * * * *